US006753760B2

(12) United States Patent
Schwartz

(10) Patent No.: US 6,753,760 B2
(45) Date of Patent: Jun. 22, 2004

(54) RANDOM OFFSET ALARM CLOCK

(76) Inventor: Adam L. Schwartz, 62 Union Ave., Campbell, CA (US) 95008

( * ) Notice: Subject to any disclaimer, the term of this patent is extended or adjusted under 35 U.S.C. 154(b) by 0 days.

(21) Appl. No.: 10/293,894

(22) Filed: Nov. 12, 2002

(65) Prior Publication Data

US 2004/0090311 A1 May 13, 2004

(51) Int. Cl.[7] ..... G08B 1/00

(52) U.S. Cl. ..... 340/309.3; 340/309.16; 340/573.1

(58) Field of Search ..... 340/309.3, 309.16, 340/309.5, 573.1, 692; 368/10, 69, 71, 73, 243

(56) References Cited

U.S. PATENT DOCUMENTS

| | | | | |
|---|---|---|---|---|
| 4,637,733 A | * | 1/1987 | Charles et al. | 368/120 |
| 5,051,967 A | * | 9/1991 | Dismond, III | 368/62 |
| 5,386,398 A | * | 1/1995 | Hiemke et al. | 368/10 |
| 6,326,881 B1 | * | 12/2001 | Dahl | 340/309.7 |
| 6,411,568 B1 | * | 6/2002 | Logan | 368/10 |

OTHER PUBLICATIONS

"Uncertainty Timepiece," retrieved on Oct. 7, 2002, Retrieved from the <http: //www.halfbakery.com/idea/Uncertainty_20Timepiece>, pp. 1–5.

"Random Alarm Clock," retrieved on Oct. 7, 2002, retrieved from <http: //www.halfbakery.com/idea/Random_20Alarm_20Clock#1030341873>, pp. 1–2.

Ram, "Dead Air Diaries," retrieved on Oct. 7, 2002, retrieved from <http: //www.author–me.com/fict02/deadair-diaries.htm>, pp. 1–4.

"Gig Alarm 1.21," retrieved on Oct. 7, 2002, retrieved from <http: //www.tucows.com/system/preview/195827.html>, pp. 1–2.

* cited by examiner

*Primary Examiner*—Daniel J. Wu
*Assistant Examiner*—Phung Nguyen
(74) *Attorney, Agent, or Firm*—Lumen Intellectual Property Services, Inc.

(57) ABSTRACT

Waking/alerting people with a random offset time added to a pre-programmed wake-up/alert time, the improved method and apparatus disclosed in the present invention maximizes time confusion and uncertainty to provide an extra urgency to get up and/or get ready. In an embodiment, an alarm clock chooses a random time offset of D minutes without the user's knowledge. The alarm sounds D minutes before the preset wake-up time while displaying the current time plus D minutes. Thus, even though a user realizes that the alarm has sounded earlier than the preset time, he does not know exactly how many minutes earlier. Alternatively, the alarm could sound D minutes after the preset wake-up time. Again, the user does not know how much offset has been inserted by the clock. This uncertainty forces the user to assume the worst-case and get up quickly.

6 Claims, 3 Drawing Sheets

RANDOM OFFSET ALARM CLOCK

FIELD OF THE INVENTION

This invention relates to the field of time keeping and, more specifically, to methods and apparatuses thereof for setting alarms based upon time plus or minus an offset of a random number of minutes.

DESCRIPTION OF THE RELATED ART

The first devices created to keep track of the time of day were probably sun clocks. The Egyptians used obelisks as early as 3500 B.C.E. to keep track of daytime hours. To obtain better accuracy and not have to rely on measurements of astrological bodies, the water clock was invented as early as 1500 B.C.E. The Greeks began using water clocks (called clepsydras—"water thief") around the year 325 B.C.E. Improvements were made during the following centuries, but significant change in the form of clocks did not occur until much later when weight driven mechanical clocks began to appear in the early $14^{th}$ century in the form of clock towers. Next, spring powered clocks were invented around 1500 and the minute-hand followed in the year 1577, invented by Jost Burgi. But significant improvement in the accuracy of time keeping occurred only with the invention of the pendulum in 1656 by Christiaan Huygens. In 1928, W. A. Morrison built the first clock based on the oscillations of a Quartz crystal providing yet another significant improvement in accuracy.

The idea of an alarm clock first involved simple concepts such as using a candle. A nail, placed into the candle wax would fall into a tin pan and make a noise when the candle burnt down to the nail. The first mechanical "wind-up" alarm clock was patented by Seth Thomas II in 1876.

Waking up in the morning or simply being on time is a difficult proposition for many people. It is quite common for people to use alarm clocks to wake or alert themselves at a predetermined time. In the current age, mechanical alarm clocks have been replaced by digital alarm clocks. Most modem alarm clocks have a snooze button that allows one to temporarily turn off or shut-off the alarm for a short period of time and thus allow the person to doze of for a few precious extra minutes of sleep. Unfortunately, this sometimes leads to oversleeping. To counteract this problem some people set their clocks ahead so that they can be deceived into thinking it is later than the actual time. Thus the person senses a greater urgency to get up. The only problem with this technique, of course, is that the person knows exactly how much time has been added to the clock and can thus calculate the actual time in his head. The effectiveness of this approach is therefore seriously compromised. Thus, there has been a long felt need for a better means capable of providing that extra urgency to get up.

The present invention addresses this need by introducing uncertainty into time being displayed. However, the history of clocks shows a progression towards ever-improving accuracy. Thus, the idea of intentionally introducing error into the time-keeping process is unusual. That is, whereas a great deal of effort has been dedicated in the time keeping art to reducing the randomness inherent in clock time bases, the present invention intentionally introduces randomness. Indeed, there are few references to such a concept.

Dahl, in U.S. Pat. No. 6,326,881, shows an alarm device that sounds at random times during the day. The purpose of the device is primarily to facilitate moments of "mindfulness, awareness, stress reduction." But this use of randomness is not employed to degrade the accuracy of the displayed time.

Two other US patents disclose random clocks whose purpose is to intentionally degrade the accuracy of the displayed time. In U.S. Pat. No. 5,386,398, Hiemke teaches a time piece that displays the time plus or minus a random offset. The random offset can change on a periodic or random basis but it is applied continuously so that, essentially, the clock simply displays the wrong time. In U.S. Pat. No. 5,051,967, Dismond teaches a clock that has a primary display and a secondary display. Like the invention of Hiemke, the primary display shows the time offset by a random amount. The secondary display is activated by the user to show the correct time. Dismond does not explain how or what happens when an alarm is activated. Thus, while these inventions show the wrong time, they do so continuously and without discussing any means for incorporating a random offset alarm function. Simply adding an alarm function to Hiemke or Dismond's invention would produce nothing more than an alarm clock whose time is set incorrectly.

Therefore, what is needed is an alarm clock that normally displays the correct time and thus functions as a useful time piece. Then, during the alarm function the clock modifies the time, unbeknownst to the user, so that when the alarm is sounded the user cannot know what the time offset is and is forced to assume the least available amount of time. The ability to add in and remove a random time offset for the alarming feature enables this alarm clock to function as an accurate time piece during normal operation while also maximizing the user's confusion about how much time he or she actually has when the alarm is sounded.

SUMMARY OF THE INVENTION

It is not uncommon for people to adjust their clocks forward by some amount, such as five or ten minutes. Setting the clock ahead in this manner helps them to wake-up on time or meet scheduled appointments by making them believe the time is later than it really is. This method relies to a certain extent on human psychology because the person obviously is aware that he or she has moved the clock forward. Despite this shortcoming people apparently do find this approach to being on time useful.

It is the object of this invention to provide an improved method for awakening people or helping them to meet scheduled appointments at pre-determined times. This object is accomplished by a random change of the time so that upon being awoken by the alarm (which could be a buzzer, radio, scent, tactile stimulus or any other means of awakening a person from sleep) the person will perceive less time to awake and get prepared than they actually have. However, unlike "setting the clock ahead", the person will not know how far changed the actual time is. As a result, the person will have to assume that the time displayed on the clock is the actual time. The urgency to get up is therefore not contravened by knowledge of the time advancement.

DETAILED DESCRIPTION OF THE INVENTION

Figure 1:
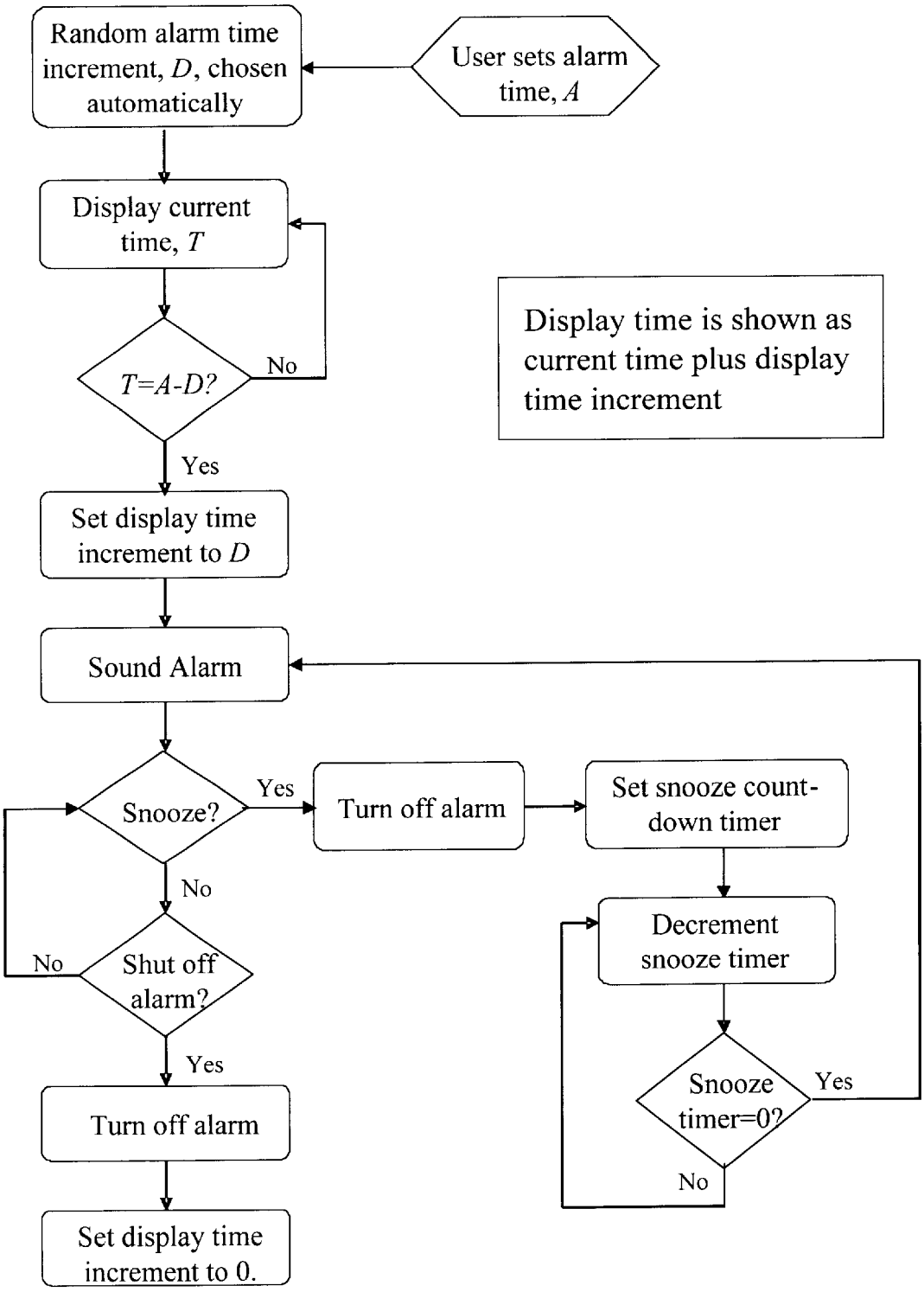
FIG. 1 shows an alarm sounding a random amount D minutes before the prescribed wake-up time and displaying the time as D minutes ahead of the actual time, according to a first embodiment of the present invention.

The functioning of the random alarm clock is preferably comprised of the following, shown in FIG. 1:

1. A chronograph that keeps track of the current time.
2. An alarm time is set by the user.
3. A random time offset is automatically selected by any reasonable random probability distribution function such as a uniform distribution, piecewise linear distribution, truncated Gaussian distribution, and truncated Poisson distribution. This time offset is unknown to the user.
4. Let T be the current time, A be the alarm time set by the user and D be the random time offset. When T=A−D the alarm is sounded and the time is displayed thereafter as T+D. The displayed time will continue to be D minutes ahead of the actual time until step 6.
5. At this point the user can snooze the alarm in which case it will sound again after a fixed time interval or the user can shut off the alarm.
6. When the alarm is shut off the displayed time reverts back to T.

Figure 2:
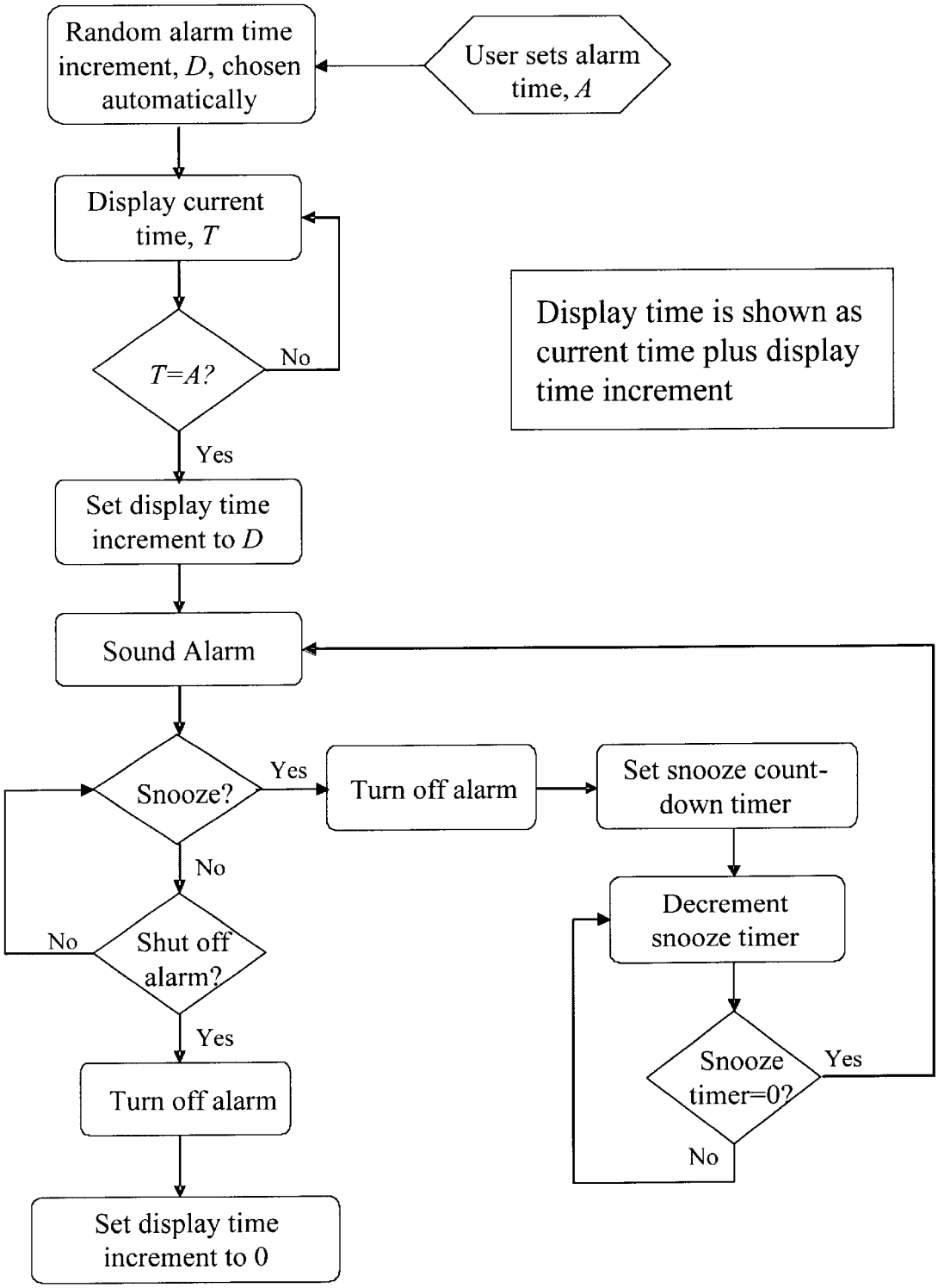
FIG. 2 shows an alarm sounding at the prescribed wake-up time but keeping the displayed time a random amount D minutes ahead of the actual time, according to a second embodiment of the present invention.

Another alternate embodiment for this invention, shown in FIG. 2, comprises the following:

1. A chronograph that keeps track of the current time.
2. An alarm time is set by the user.
3. A random time offset is automatically selected by any reasonable random probability distribution function such as those disclose herein. This time offset is unknown to the user.
4. Let T be the current time, A be the alarm time set by the user and D be the random time offset. When T=A the alarm is sounded. However, the displayed time is T+D. The displayed time will continue to be D minutes ahead of the actual time until step 6.
5. At this point the user can snooze the alarm in which case it will sound again after a fixed time interval or the user can shut off the alarm.
6. When the alarm is shut off the displayed time reverts back to T.

Figure 3:
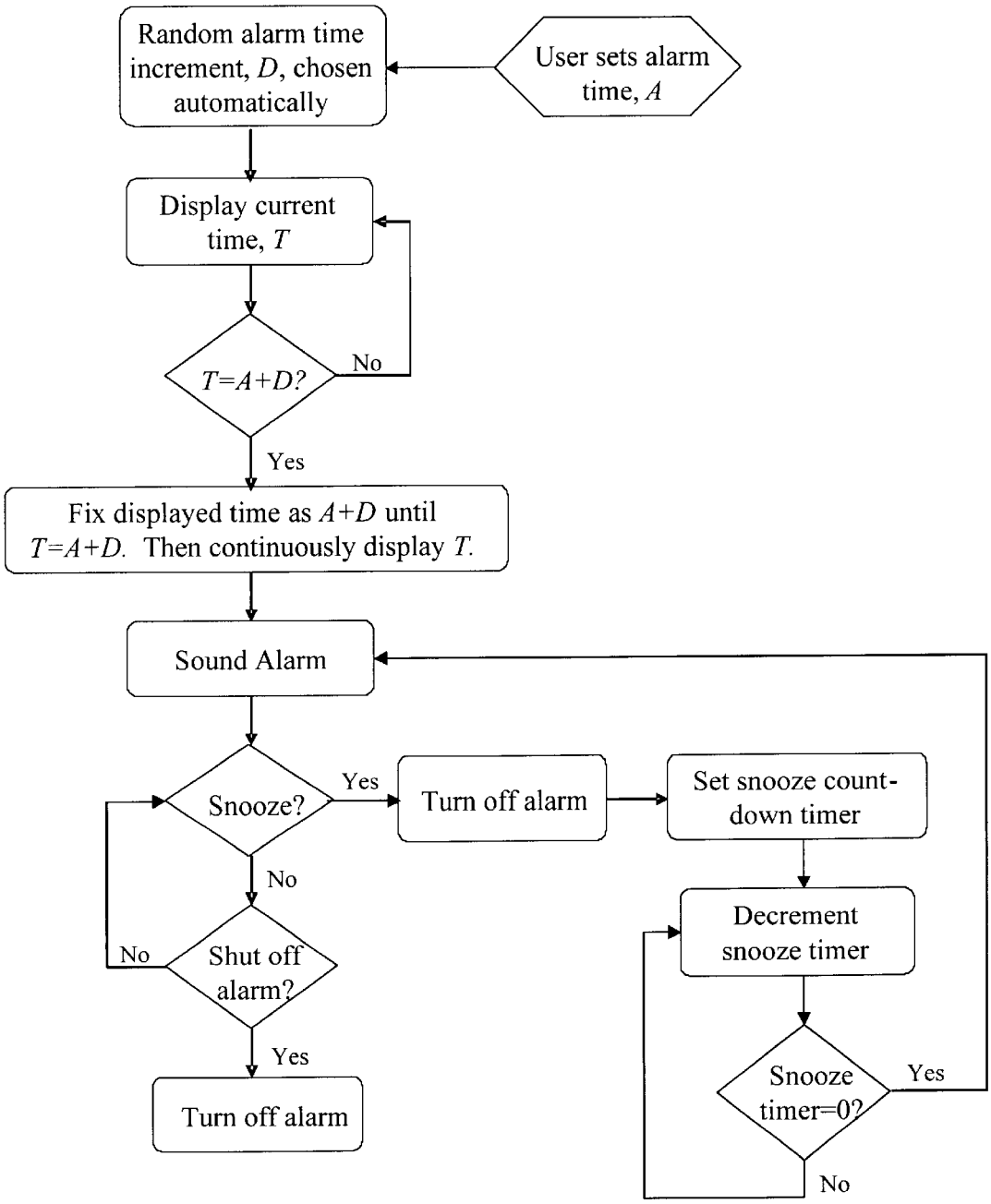
FIG. 3 shows an alarm sounding a random amount D minutes after the prescribed wake-up time and keeping the displayed time fixed as preset alarm time A plus D minutes until the actual time equals A+D, according to a third embodiment of the present invention.

Yet an alternate embodiment for this invention comprises the following, shown in FIG. 3:

1. The invention has a chronograph that keeps track of the current time.
2. An alarm time is set by the user.
3. A random time offset is automatically selected by any reasonable random probability distribution function such as those disclosed herein. This time offset is unknown to the user.
4. Let T be the current time, A be the alarm time set by the user and D be the random time offset. When T=A+D the alarm is sounded. The time is displayed as A+D and the display remains fixed until step 6.
5. At this point the user can snooze the alarm in which case it will sound again after a fixed time interval or the user can shut off the alarm.
6. The displayed time is shown as A+D for until the actual time, T=A+D. At this time the displayed time reverts to the actual time T.

In this third embodiment the user would intentionally have to program the alarm time to be earlier than needed since he would not know how much after the alarm time setting the alarm would actually sound. For example, suppose the random time offset is uniformly distributed between 0 minutes and 20 minutes. If the user wants to awake at 8:00 am he will have to set the alarm for A=7:40 am in order to ensure that the alarm sounds by 8:00 am. However, when the alarm sounds the displayed time will say anything between 7:40 am and 8:00 am regardless of the actual time. So, even though the user knows that the actual time T is between 7:40 am and 8:00 am, he will have to assume that the actual time is 8:00 am.

Clearly, any of the different versions of step 6 can be used in any of these embodiments. Furthermore, it will be recognized by anyone familiar with the art that many variations on the above stated algorithms can be created without substantially deviating from the scope of this invention. For instance, an algorithm that displays the current time minus a random offset once the alarm is activated is possible. Also, the choice of random probability distribution for the random time offset does not materially affect the nature of this invention.

In summary, the present invention provides an effective way for a person to deceive himself into thinking that the time is later than it actually is and thus be forced to get up. By selectively activating the random offset alarm function only at certain preset time, the present invention advantageously maximizes time confusion and uncertainty to provide the extra urgency to get up and/or get ready, fulfilling a long felt need in the art.

It should be noted that a similar effect can be obtained by speeding up or slowing down the chronometer in the clock. For instance, the clock could be sped up, at a randomly chosen speed, as the alarm time approaches. Or, the clock could be automatically adjusted such that, when the alarm sounds, the clock displays the current time plus a random offset time minus S where S is set to 0 initially. S is then incremented until S is the same or equal to the random offset time, at and after which time the clock displays normal (accurate) time again.

Although the present invention and its advantages have been described in detail, it should be understood that various changes, substitutions, and alternations could be made and/or implemented without departing from the principles and the scope of the invention. For example, the random offset alarm function can be integrated into or otherwise implemented in any time keeping devices including watches, clocks, computers, personal digital assistant (PDA), etc. Accordingly, the scope of the present invention should be determined by the following claims and their legal equivalents.

I claim:

1. An apparatus comprising:

a chronometer for accurately and continuously measuring time T;

an interface means for receiving input from animate and inanimate entities for setting an alert time A;

a time offset generating means for automatically generating a pseudorandom offset time D each time the alert time A is set, wherein the offset time D is unknown to a user of the apparatus;

a monitoring means for determining whether T=T1; and a time displaying means for continuously displaying T until T=T1 at which time the time displaying means displays T2 and an alert mechanism is substantially simultaneously activated, the time displaying means thereafter continuously displaying T2, wherein T1 is selected from the group consisting of T1=A−D, T1=A, and T1=A+D, and T2 is selected from the group consisting of T2=T+D, T2=A, and T2=A+D.

2. The apparatus of claim 1, further comprising:

an alert shut-off mechanism for deactivating the alert mechanism, which, when applied, causes the time displaying means to continuously display T.

3. The apparatus of claim 2, further comprising:

a controller means for controlling the chronometer, the interface means, the time offset generating means, the monitor means, the time displaying means, the alert mechanism, and the alert shut-off mechanism.

4. The apparatus of claim 1, further comprising:

a snoozing means for temporarily deactivating the alert mechanism for a predetermined time, the time displaying means continuously displaying T2 during the predetermined time.

5. The apparatus of claim 1, further comprising:

a time adjusting means for automatically adjusting T2 such that, when the alert mechanism is substantially simultaneously activated at T1, the time displaying means displays T2=T+D−S where S=0 initially and where S is incremented periodically thereafter until S≧D, at and after which time the time displaying means continuously displaying T.

6. The apparatus of claim 1, wherein the time offset generating means generates the pseudo-random offset time D by a random probability distribution function selected from the group consisting of uniform distribution, piecewise linear distribution, truncated Gaussian distribution, and truncated Poisson distribution.

* * * * *